US011988218B2

(12) United States Patent
Kruizenga et al.

(10) Patent No.: US 11,988,218 B2
(45) Date of Patent: May 21, 2024

(54) ELECTRIC COOLANT PUMP WITH EXPANSION COMPENSATING SEAL

(71) Applicant: MULTI PARTS SUPPLY USA, INC., Jupiter, FL (US)

(72) Inventors: Brandon Christopher Kruizenga, West Palm Beach, FL (US); Stephen Christopher Trance, Jupiter, FL (US)

(73) Assignee: MULTI PARTS SUPPLY USA, INC., Jupiter, FL (US)

( * ) Notice: Subject to any disclaimer, the term of this patent is extended or adjusted under 35 U.S.C. 154(b) by 153 days.

(21) Appl. No.: 17/684,491

(22) Filed: Mar. 2, 2022

(65) Prior Publication Data

US 2022/0290683 A1 Sep. 15, 2022

Related U.S. Application Data

(60) Provisional application No. 63/158,924, filed on Mar. 10, 2021.

(51) Int. Cl.
*F04D 29/08* (2006.01)
*F04D 13/02* (2006.01)
(Continued)

(52) U.S. Cl.
CPC ..... *F04D 29/086* (2013.01); *F04D 13/026* (2013.01); *F04D 13/06* (2013.01);
(Continued)

(58) Field of Classification Search
CPC ..... F04D 13/0606; F04D 13/0633; F04D 29/106; F04D 13/06; F04D 29/086;
(Continued)

(56) References Cited

U.S. PATENT DOCUMENTS 2,713,311 A * 7/1955 White ..... H02K 5/128 417/357
3,143,676 A * 8/1964 Niemkiewicz ..... F04D 13/0613 310/86

(Continued)

FOREIGN PATENT DOCUMENTS

DE 102006039294 A1 3/2007
DE 112015005074 T5 7/2017

(Continued)

OTHER PUBLICATIONS

Extended European Search Report—Multi Parts Supply USA, Inc.—Application No. 22160918.3—dated Mar. 8, 2022.

*Primary Examiner* — Peter J Bertheaud
(74) *Attorney, Agent, or Firm* — BrownWinick Law Firm; Christopher A. Proskey

(57) ABSTRACT

An electric coolant pump system is presented including a housing having a main body and an end cap. The main body having a hollow interior and an open end. The end cap is operably connected to the main body and closes the open end of the main body. The system includes a rotor shaft operably connected to the housing. The system includes a rotor operably connected to the rotor shaft and positioned within the hollow interior. The system includes an impeller operably connected to the rotor. The system includes a stator configured to generate a rotating electromagnetic field during operation. The rotor is configured to rotate the impeller in response to the rotating electromagnetic field. The impeller is configured to pump a coolant when rotated. One or more components of the electric coolant pump system thermally expand and contract as the coolant is heated and cooled.

15 Claims, 13 Drawing Sheets

(51) Int. Cl.

| | |
|---|---|
| ***F04D 13/06*** | (2006.01) |
| ***F04D 29/02*** | (2006.01) |
| ***F04D 29/043*** | (2006.01) |
| ***F04D 29/10*** | (2006.01) |
| ***F04D 29/12*** | (2006.01) |
| ***F04D 29/40*** | (2006.01) |
| ***F04D 29/42*** | (2006.01) |
| ***F04D 29/58*** | (2006.01) |

(52) U.S. Cl.
CPC ..... *F04D 13/0606* (2013.01); *F04D 13/0626* (2013.01); *F04D 13/0633* (2013.01); *F04D 29/026* (2013.01); *F04D 29/043* (2013.01); *F04D 29/106* (2013.01); *F04D 29/126* (2013.01); *F04D 29/406* (2013.01); *F04D 29/426* (2013.01); *F04D 29/586* (2013.01)

(58) Field of Classification Search
CPC .... F04D 29/126; F04D 13/026; F04D 29/026; F04D 29/043; F04D 29/426; F04D 13/0626; F04D 29/406; F04D 29/586
See application file for complete search history.

(56) References Cited

U.S. PATENT DOCUMENTS

| | | | |
|---|---|---|---|
| 4,936,742 | A | 6/1990 | Eguchi et al. |
| 5,655,893 | A | 8/1997 | Kubo |
| 5,690,471 | A | 11/1997 | Sasaki |
| 5,713,726 | A | 2/1998 | Nakayoshi |
| 5,779,327 | A | 7/1998 | Nakashima et al. |
| 5,785,491 | A | 7/1998 | Ozawa et al. |
| 5,797,722 | A | 8/1998 | Sasaki et al. |
| 5,842,828 | A | 12/1998 | Ozawa et al. |
| 5,915,927 | A | 6/1999 | Kuromitsu |
| 5,950,577 | A | 9/1999 | Sasaki et al. |
| 6,027,318 | A | 2/2000 | Shimanuki et al. |
| 6,062,812 | A | 5/2000 | Ozawa |
| 6,199,518 | B1 | 3/2001 | Hotta et al. |
| 6,199,528 | B1 | 3/2001 | Hotta et al. |
| 6,216,454 | B1 | 4/2001 | Tsuzuki |
| 6,273,687 | B1 | 8/2001 | Nogimori et al. |
| 6,305,910 | B1 | 10/2001 | Miura et al. |
| 6,561,756 | B2 | 5/2003 | Ozawa et al. |
| 6,638,015 | B2 | 10/2003 | Ozawa et al. |
| 6,764,278 | B2 | 7/2004 | Ozawa et al. |
| 6,776,586 | B2 | 8/2004 | Naito et al. |
| 6,793,459 | B2 | 9/2004 | Chujo et al. |
| 6,960,066 | B2 | 11/2005 | Koga et al. |
| 7,014,131 | B2 | 3/2006 | Berning |
| 7,036,207 | B2 | 5/2006 | Neal |
| 7,036,892 | B2 | 5/2006 | Suzuki et al. |
| 7,067,944 | B2 | 6/2006 | Lieu |
| 7,067,952 | B2 | 6/2006 | Neal |
| 7,154,200 | B2 | 12/2006 | Neal |
| 7,287,630 | B2 | 10/2007 | Takahashi |
| 7,311,499 | B2 | 12/2007 | Hattori et al. |
| 7,396,215 | B2 | 7/2008 | Ozawa et al. |
| 7,444,807 | B2 | 11/2008 | Tsuzuki et al. |
| 7,683,509 | B2 | 3/2010 | Neal |
| 7,690,335 | B2 | 4/2010 | Togawa et al. |
| 7,704,040 | B2 | 4/2010 | Yamazaki et al. |
| 7,785,085 | B2 | 8/2010 | Maeda et al. |
| 7,874,814 | B2 | 1/2011 | Mori et al. |
| 7,891,959 | B2 | 2/2011 | Harada et al. |
| 7,911,091 | B2 | 3/2011 | Takenaka et al. |
| 7,922,464 | B2 | 4/2011 | Adachi et al. |
| 7,928,348 | B2 | 4/2011 | Neal |
| 7,931,454 | B2 | 4/2011 | Yamaguchi et al. |
| 8,029,246 | B2 | 10/2011 | Hanai et al. |
| 8,038,423 | B2 | 10/2011 | Nakayoshi |
| 8,079,828 | B2 | 12/2011 | Togawa et al. |
| 8,172,162 | B2 | 5/2012 | Gopalan |
| 8,231,356 | B2 | 7/2012 | Matsutani et al. |
| 8,292,499 | B2 | 10/2012 | Nakagaki et al. |
| 8,408,168 | B2 | 4/2013 | Suzuki et al. |
| 8,419,353 | B2 | 4/2013 | Hotta et al. |
| 8,522,947 | B2 | 9/2013 | Komai et al. |
| 8,545,191 | B2 | 10/2013 | Ikegawa et al. |
| 8,556,596 | B2 | 10/2013 | Ikegawa |
| 8,567,579 | B2 | 10/2013 | Nakamura et al. |
| 8,596,053 | B2 | 12/2013 | Maeda et al. |
| 8,657,586 | B2 | 2/2014 | Achor |
| 8,696,333 | B2 | 4/2014 | Ishiguro |
| 8,784,073 | B2 | 7/2014 | Nomura et al. |
| 8,839,924 | B2 | 9/2014 | Takikawa et al. |
| 8,888,467 | B2 | 11/2014 | Nakamura |
| 8,911,220 | B2 | 12/2014 | Hattori |
| 9,017,044 | B2 | 4/2015 | Nakai et al. |
| 9,080,573 | B2 | 7/2015 | Schwabische |
| 9,109,497 | B2 | 8/2015 | Matsusaka et al. |
| 9,140,245 | B2 | 9/2015 | Nakai et al. |
| 9,163,627 | B2 | 10/2015 | Kawase et al. |
| 9,175,679 | B2 | 11/2015 | Shimizu et al. |
| 9,267,473 | B2 | 2/2016 | Troxler |
| 9,401,670 | B2 | 7/2016 | Minato |
| 9,416,786 | B2 | 8/2016 | Schwabische |
| 9,470,219 | B2 | 10/2016 | Kato et al. |
| 9,551,337 | B2 | 1/2017 | Kokubu et al. |
| 9,581,076 | B2 | 2/2017 | Mushiga et al. |
| 9,719,522 | B2 | 8/2017 | Yamamoto |
| 9,777,740 | B2 | 10/2017 | Chiba et al. |
| 9,903,365 | B2 | 2/2018 | Isoda et al. |
| 9,957,957 | B2 | 5/2018 | Ishikawa et al. |
| 10,001,131 | B2 | 6/2018 | Chiba et al. |
| 10,190,671 | B2 | 1/2019 | Kito et al. |
| 10,196,961 | B2 | 2/2019 | Takagi et al. |
| 10,302,081 | B2 | 5/2019 | Yamamoto et al. |
| 10,344,775 | B2 | 7/2019 | Koga et al. |
| 10,468,922 | B2 | 11/2019 | Endo et al. |
| 10,495,019 | B2 | 12/2019 | Blackman |
| 10,527,061 | B2 | 1/2020 | Fukuyama et al. |
| 10,533,579 | B2 | 1/2020 | Mochizuki et al. |
| 10,550,730 | B2 | 2/2020 | Tateno |
| 10,816,003 | B2 | 10/2020 | Hiratsuka et al. |
| 10,920,785 | B2 | 2/2021 | Hattori et al. |
| 11,333,136 | B2 | 5/2022 | Ono et al. |
| 2002/0002321 | A1 | 1/2002 | Tsukahara et al. |
| 2003/0021709 | A1 | 1/2003 | Okuya et al. |
| 2005/0025642 | A1 | 2/2005 | Deai |
| 2005/0069440 | A1 | 3/2005 | Naito |
| 2005/0249589 | A1 | 11/2005 | Ozawa et al. |
| 2006/0171818 | A1 | 8/2006 | Kato |
| 2006/0210394 | A1 | 9/2006 | Nakano |
| 2006/0222527 | A1 | 10/2006 | Kurita et al. |
| 2007/0018521 | A1 | 1/2007 | Ishiguro et al. |
| 2007/0092392 | A1 | 4/2007 | Kurokawa |
| 2009/0097996 | A1 | 4/2009 | Sakumoto |
| 2010/0025177 | A1 | 2/2010 | Fukushima et al. |
| 2010/0077743 | A1 | 4/2010 | Mori et al. |
| 2010/0080690 | A1 | 4/2010 | Horie et al. |
| 2010/0098565 | A1 | 4/2010 | Ishiguro et al. |
| 2010/0119391 | A1 | 5/2010 | Colic |
| 2011/0120394 | A1 | 5/2011 | Onozawa et al. |
| 2012/0031722 | A1 | 2/2012 | Takikawa et al. |
| 2012/0244014 | A1 | 9/2012 | Nakai et al. |
| 2012/0244025 | A1 | 9/2012 | Nakai et al. |
| 2013/0142680 | A1 | 6/2013 | Tamawari et al. |
| 2013/0195696 | A1 | 8/2013 | Sugimura et al. |
| 2014/0017073 | A1 | 1/2014 | Muizelaar |
| 2014/0112812 | A1 | 4/2014 | Takemi |
| 2014/0294600 | A1 | 10/2014 | Takuda et al. |
| 2015/0023798 | A1 | 1/2015 | Komai et al. |
| 2015/0226212 | A1 | 8/2015 | Hisada et al. |
| 2015/0292493 | A1 | 10/2015 | Suzuki |
| 2016/0025095 | A1 | 1/2016 | Hattori et al. |
| 2016/0356271 | A1 | 12/2016 | Iwase et al. |
| 2017/0016442 | A1 | 1/2017 | Hazama et al. |
| 2017/0037769 | A1 | 2/2017 | Yoshida et al. |
| 2017/0089251 | A1 | 3/2017 | Shimatani et al. |
| 2017/0219083 | A1 | 8/2017 | Ito et al. |
| 2018/0087514 | A1 | 3/2018 | Miyazaki et al. |
| 2018/0128279 | A1 | 5/2018 | Ogawa |

(56) References Cited

U.S. PATENT DOCUMENTS

| | | | |
|---|---|---|---|
| 2018/0179944 | A1 | 6/2018 | Endo |
| 2018/0238325 | A1 | 8/2018 | Ando et al. |
| 2018/0252147 | A1 | 9/2018 | Watanabe et al. |
| 2018/0262148 | A1 | 9/2018 | Endo |
| 2019/0277280 | A1 | 9/2019 | Shimatani et al. |
| 2019/0277294 | A1 | 9/2019 | Hoshiko |
| 2019/0316594 | A1 | 10/2019 | Hattori et al. |
| 2019/0353168 | A1 | 11/2019 | Fujikawa |
| 2020/0032789 | A1 | 1/2020 | Kurokawa et al. |
| 2020/0036306 | A1 | 1/2020 | Aoyagi et al. |
| 2020/0049249 | A1 | 2/2020 | Iwase et al. |

FOREIGN PATENT DOCUMENTS

| | | | |
|---|---|---|---|
| EP | 1117169 | | 7/2001 |
| EP | 1522738 | | 4/2005 |
| EP | 2657416 | A3 | 12/2015 |
| EP | 3002809 | A1 | 4/2016 |
| EP | 2918839 | B1 | 8/2016 |
| EP | 2930368 | B1 | 4/2019 |
| JP | H09317683 | | 12/1997 |

* cited by examiner

ELECTRIC COOLANT PUMP WITH EXPANSION COMPENSATING SEAL

CROSS REFERENCE TO RELATED APPLICATIONS

This application claims the benefit of U.S. Provisional Application No. 63/158,924 filed Mar. 10, 2021, the entirety of which is fully incorporated here by reference.

FIELD OF THE DISCLOSURE

This disclosure relates generally to electric coolant pumps. More specifically and without limitation, this disclosure relates to automotive electric coolant pumps.

OVERVIEW OF THE DISCLOSURE

Internal combustion engines reach high temperatures due to the temperature of combustion gases that are burnt within a cylinder. A cooling system is required to prevent the engine from overheating and damaging components. Typically, a cooling system includes an electric coolant pump (e.g., an electric coolant pump), which is used to circulate a coolant so that the engine is maintained at a proper temperature. More specifically, coolant is circulated through a cylinder block and/or a cylinder heads of the engine and a radiator. In this process, heat is transferred from the engine to the coolant, and then from the coolant to outside air by the radiator.

Generally, electric coolant pumps include a stator and a rotor that are encased in a housing. The rotor is connected to an impeller for moving fluid from an inlet of the pump to an outlet of the pump. In some electric coolant pumps, the housing may be opened, for example by removing a cover, to permit components to be serviced or replaced. Such pumps include one or more seals to prevent the fluid moved by the impeller from leaking out of the housing.

However, it can be difficult to maintain a seal in electric coolant pumps due to thermal cycling of engines, which causes components of an electric coolant pump to expand when the engine warms up and contract when the engine cools down. In particular, various components of an electric coolant pump may be formed of materials having different coefficients of thermal expansion. Accordingly, components may expand and contract at different rates, thereby creating undesirable gaps. As a result, it can be difficult to provide a water tight seal that functions correctly through the entire thermal range of an engine and has a satisfactory lifespan.

For the reasons stated above, and for other reasons stated below which will become apparent to those skilled in the art upon reading and understanding the disclosure, there is a need in the art for an electric coolant pump system that improves upon the state of the art.

Thus, it is an object of at least one embodiment of the disclosure to provide an electric coolant pump system that improves upon the state of the art.

Another object of at least one embodiment of the disclosure is to provide an electric coolant pump system that has a seal configured to compensate for thermal expansion/contraction of components.

Yet another object of at least one embodiment of the disclosure is to provide an electric coolant pump system that is serviceable.

Another object of at least one embodiment of the disclosure is to provide an electric coolant pump system that has a durable design.

Yet another object of at least one embodiment of the disclosure is to provide an electric coolant pump system that has a long useful life.

Another object of at least one embodiment of the disclosure is to provide an electric coolant pump system that is low cost.

Yet another object of at least one embodiment of the disclosure is to provide an electric coolant pump system that is easy to manufacture.

These and other objects, features, or advantages of at least one embodiment will become apparent from the specification, figures, and claims.

BRIEF SUMMARY OF THE DISCLOSURE

In one or more arrangements an electric coolant pump system is presented. The system includes a housing having a main body and an end cap. The main body having a hollow interior and an open end. The end cap is operably connected to the main body and closes the open end of the main body. The system includes a rotor shaft operably connected to the housing. The system includes a rotor operably connected to the rotor shaft and positioned within the hollow interior. The system includes an impeller operably connected to the rotor. The system includes a stator configured to generate a rotating electromagnetic field during operation. The rotor is configured to rotate the impeller in response to the rotating electromagnetic field. The impeller is configured to pump a coolant when rotated. One or more components of the electric coolant pump system thermally expand and contract as the coolant is heated and cooled.

DETAILED DESCRIPTION

Figure 1:
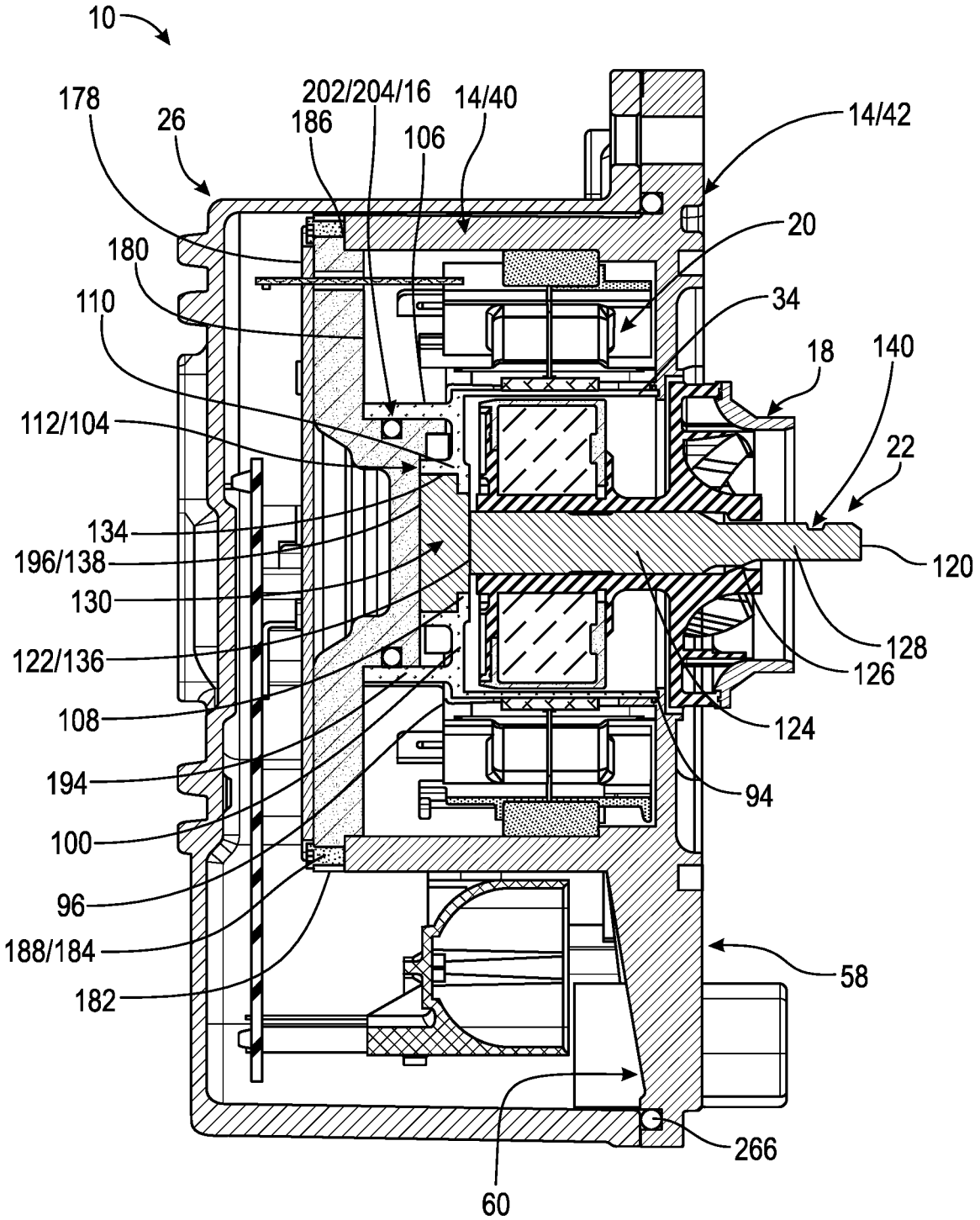
FIG. 1 is a cut away perspective view of an electric coolant pump with an expansion compensating seal having a housing which holds a rotor shaft, a rotor tube, a rotor-impeller assembly, and an expansion compensating seal.
Figure 2:
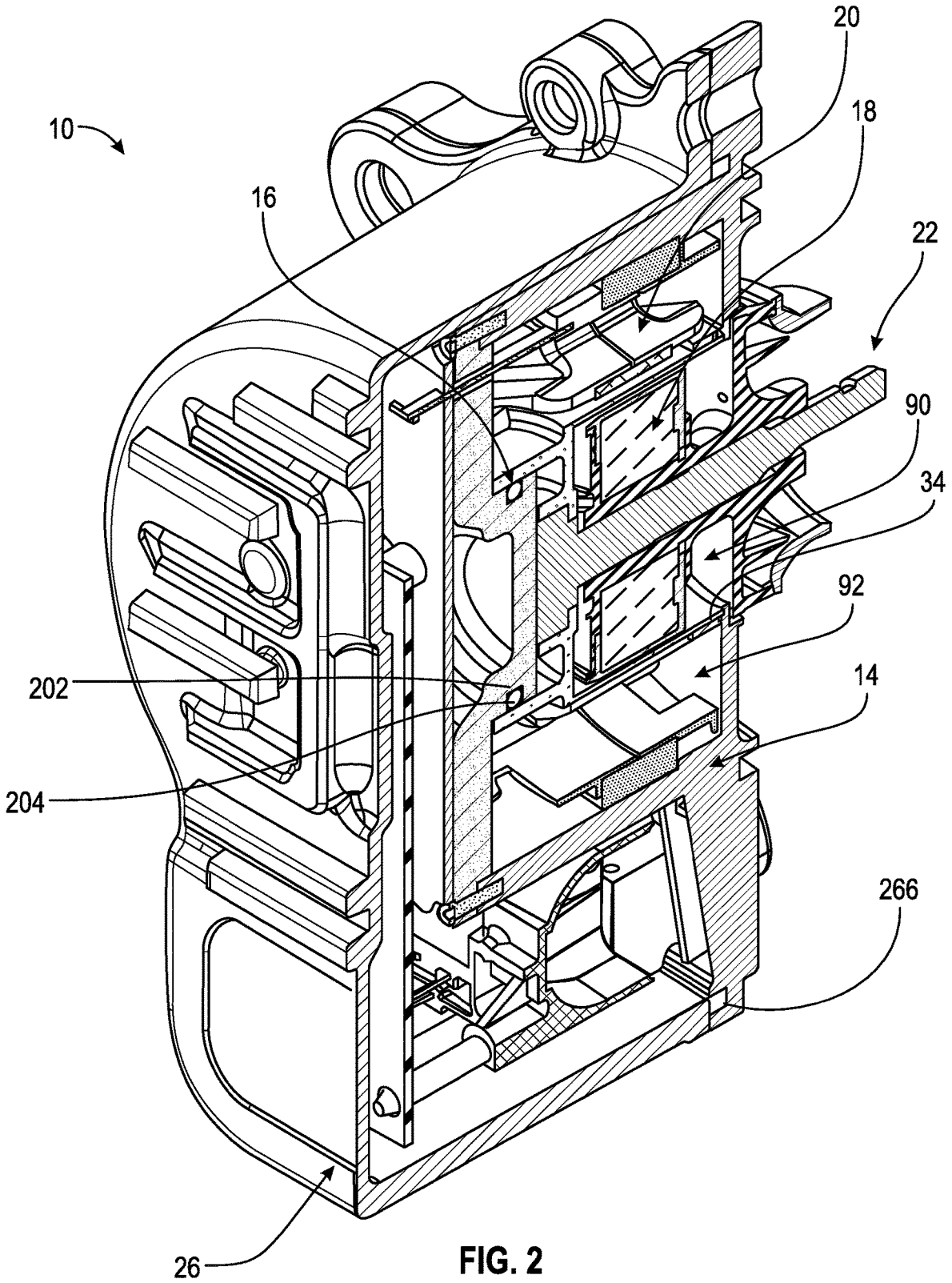
FIG. 2 is an alternative cut away perspective view of an electric coolant pump with an expansion compensating seal as described in FIG. 1, the electric coolant pump having a housing which holds a rotor shaft and rotor leading to an end cap, wherein an expansion compensating seal provides a water tight seal between the end cap and the main body of the housing.
Figure 3:
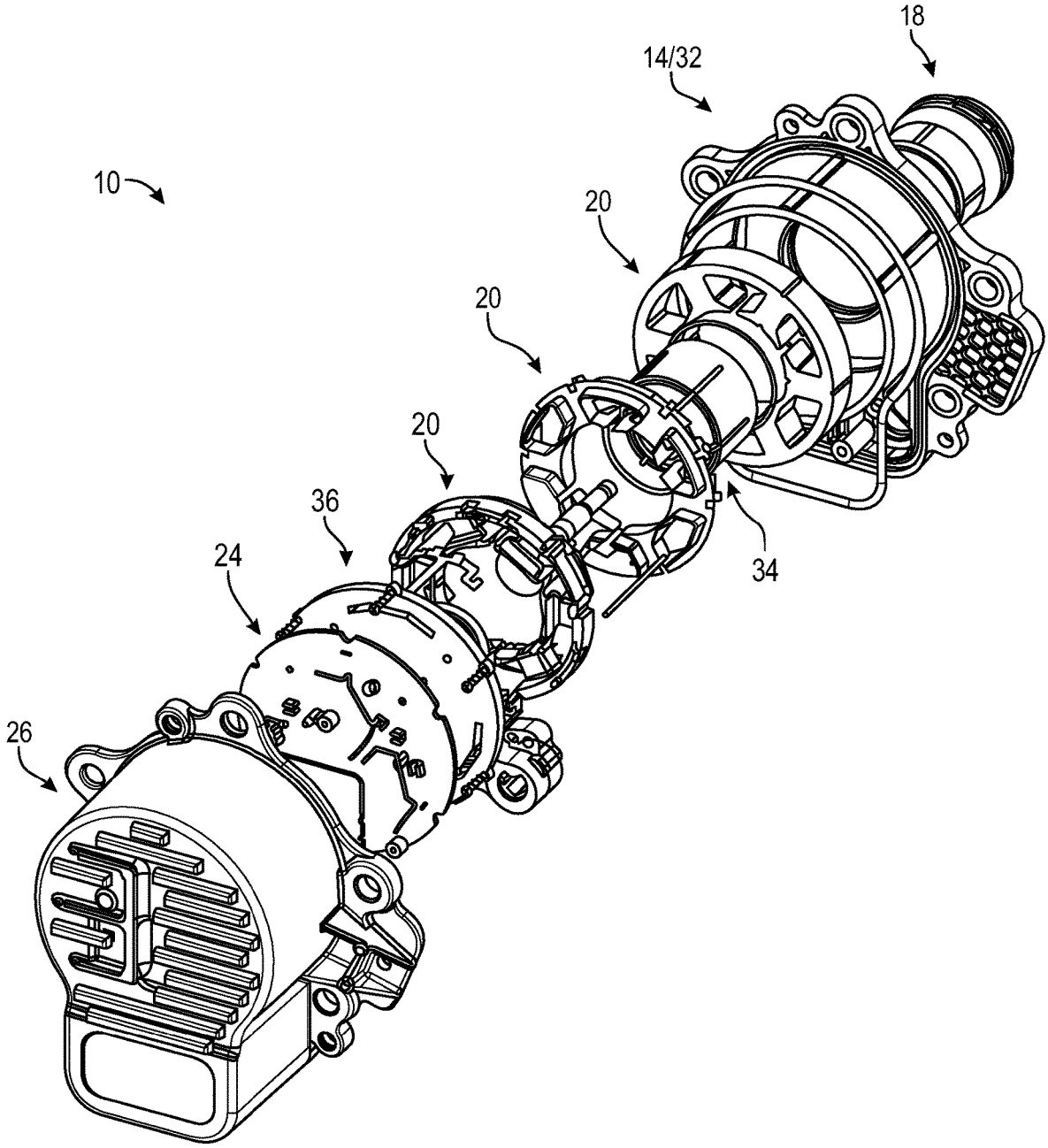
FIG. 3 is an expanded view of an electric coolant pump with an expansion compensating seal as described in FIG. 1, showing the control circuit, end cap and stator layered between the cover and main body of the housing with the rotor-impeller assembly configured to fit within the main body of the housing.
Figure 4:
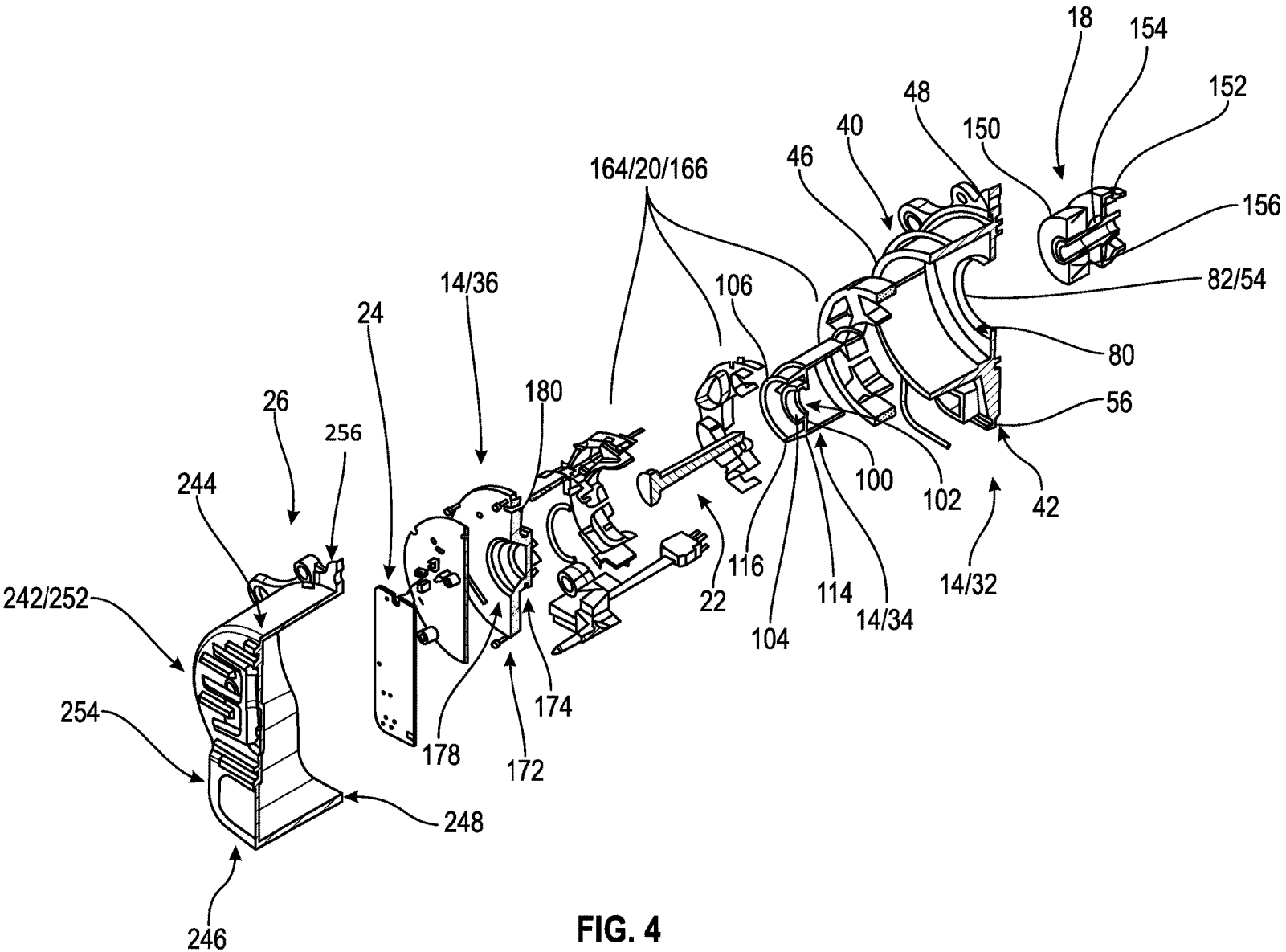
FIG. 4 is a cut away of the expanded view of an electric coolant pump as described in FIG. 3.
Figure 5:
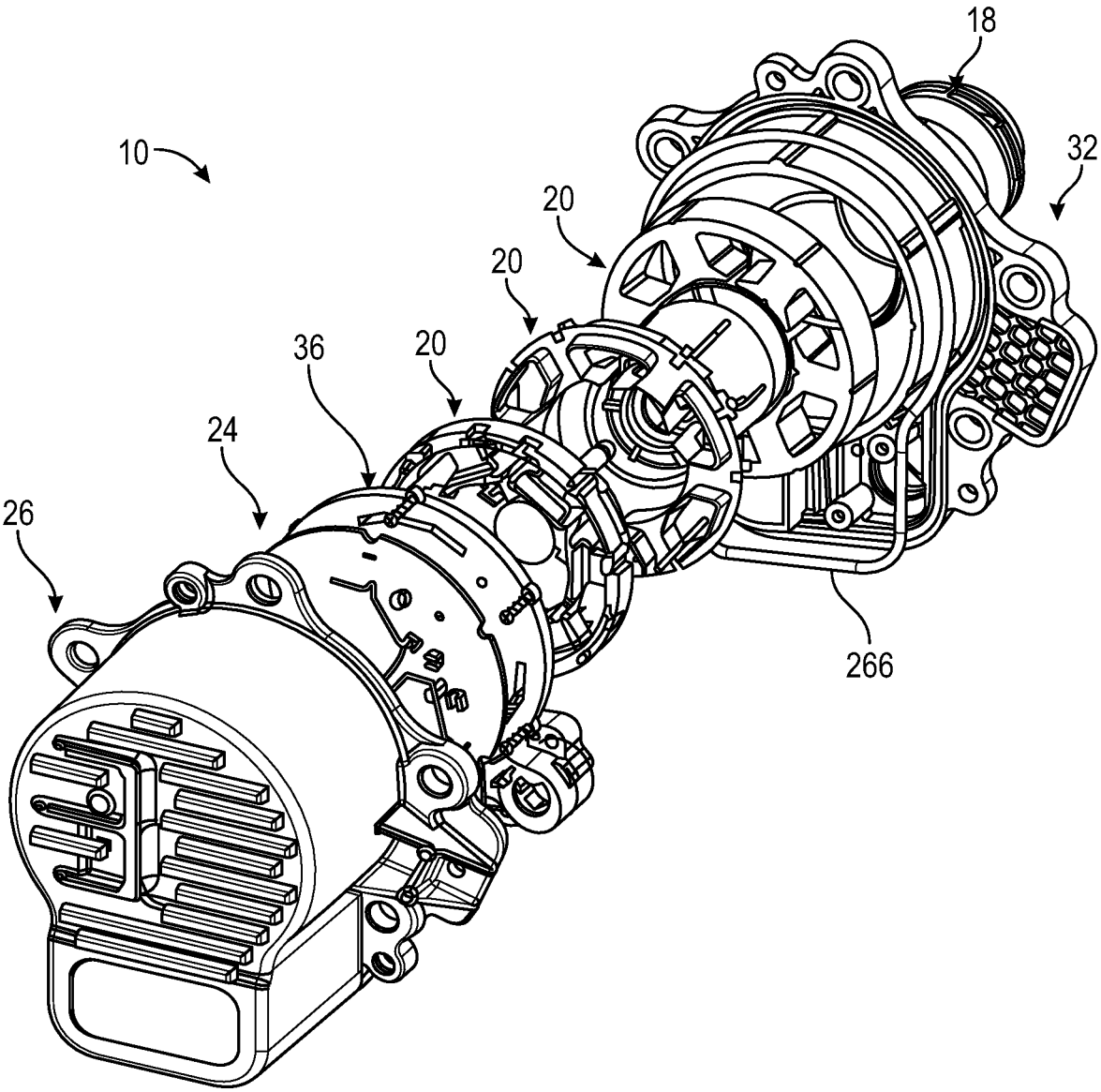
FIG. 5 is an alternative expanded view of the electric coolant pump as described in FIG. 1, showing the control circuit, end cap, and stator layered between the cover and main body of the housing with the rotor impeller assembly configured to fit within the main body of the housing.
Figure 6:
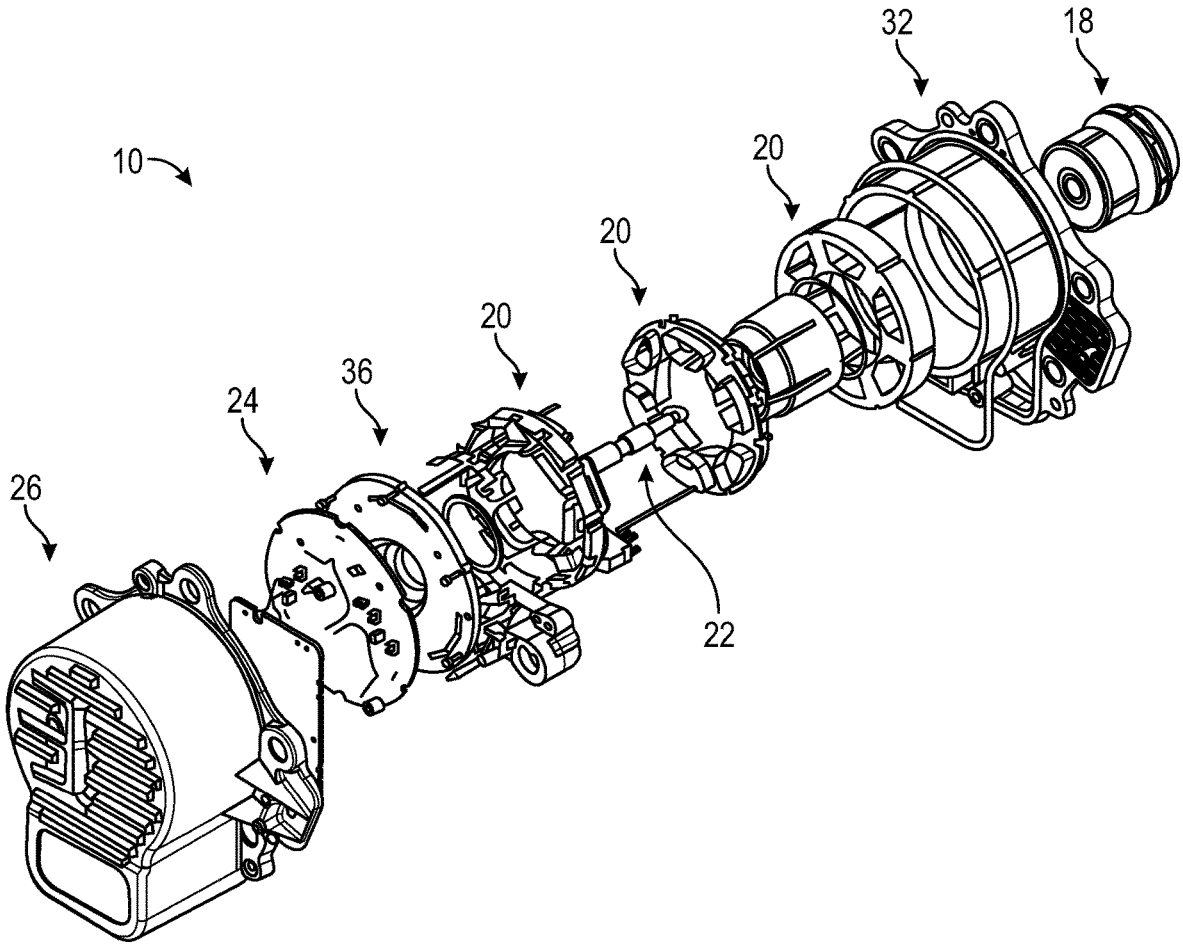
FIG. 6 is an alternative expanded view of the electric coolant pump as described in FIG. 1, showing the control circuit, end cap, stator located within the housing with the rotor impeller assembly configured to fit within the main body of the housing.
Figure 7:
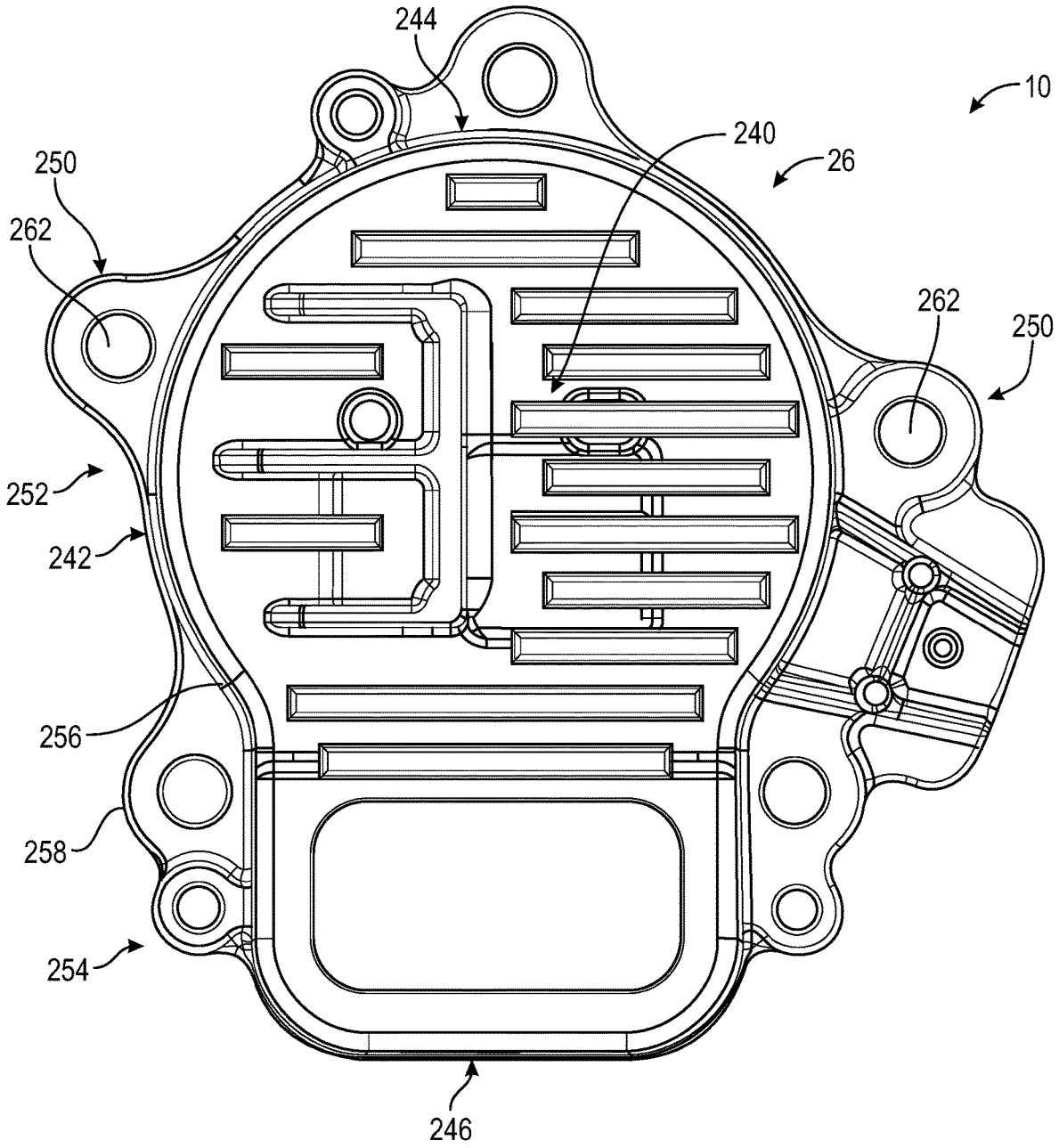
FIG. 7 is a perspective view of the electric coolant pump as described in FIG. 1 showing the cover of the housing with various flanges located on the cover of the housing.
Figure 8:
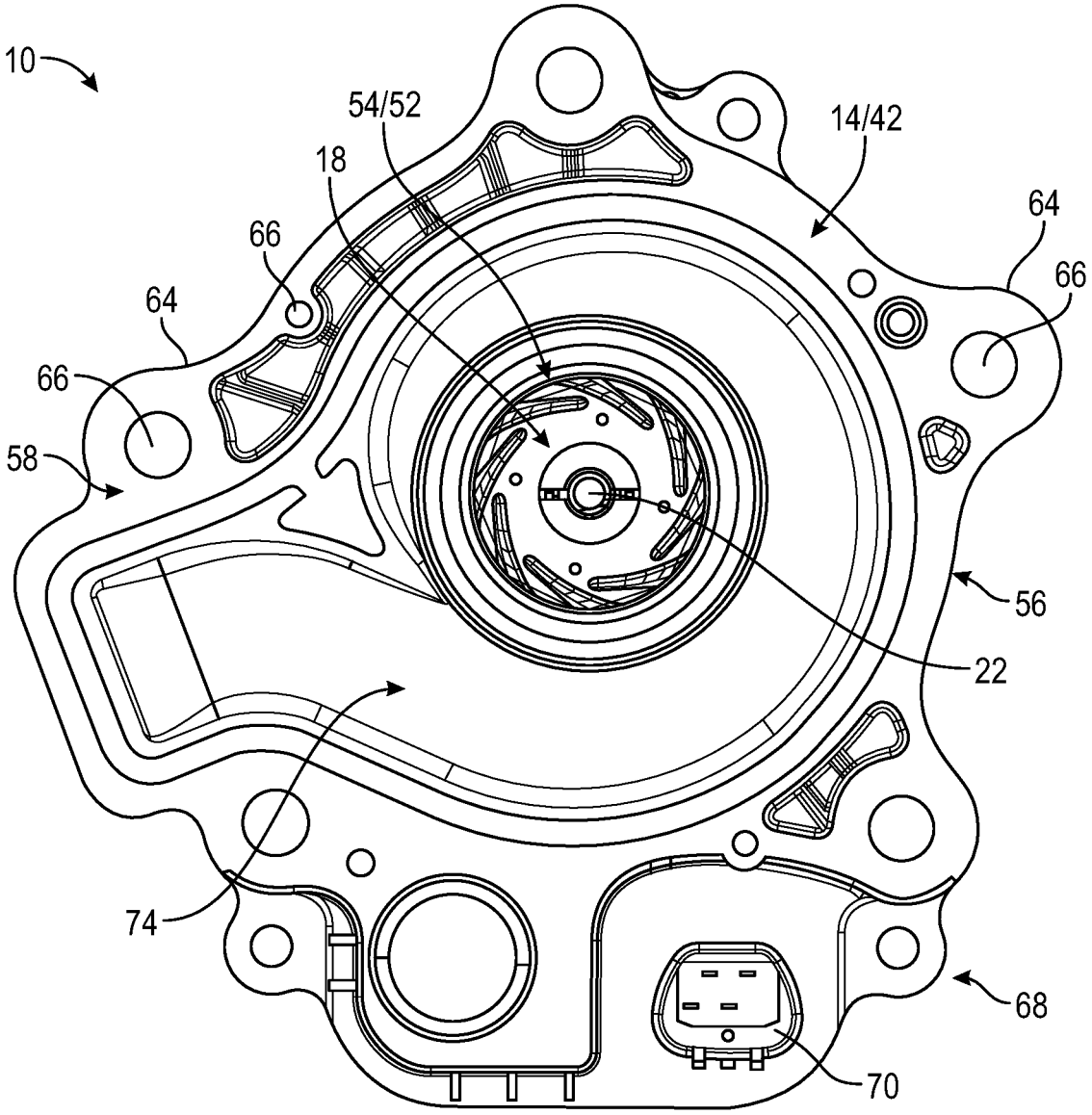
FIG. 8 is a perspective view of the electric coolant pump as described in FIG. 1 showing the rear portion of the main body with an electrical connector, recess, and various holes located along the rear portion.
Figure 9:
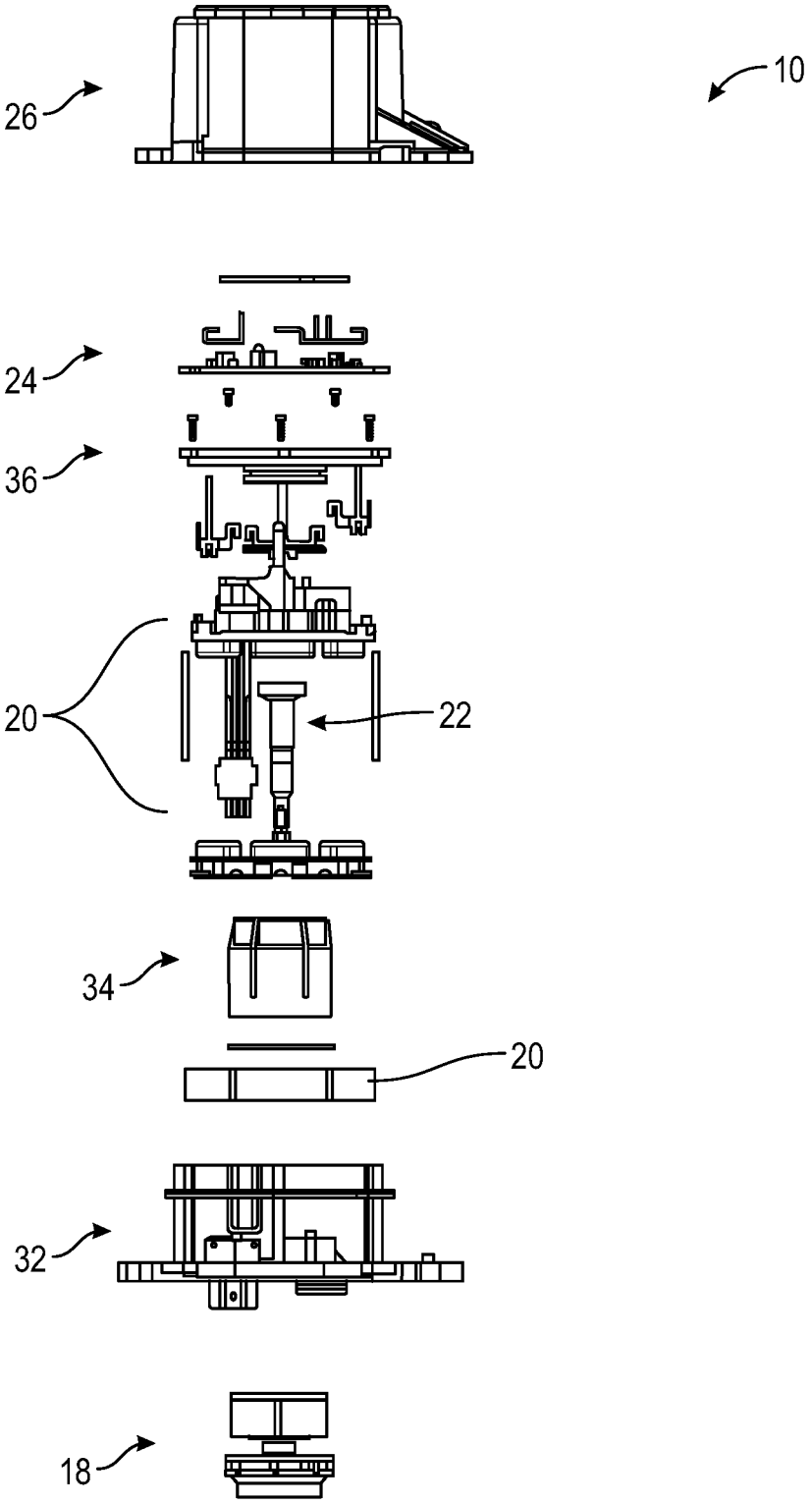
FIG. 9 is a top expanded view of the electric coolant pump as described in FIG. 1 showing the control circuit, end cap, stator, rotor shaft, and rotor tube layered between the cover and main body of the housing with the rotor-impeller assembly configured to fit within the main body of the housing.
Figure 10:
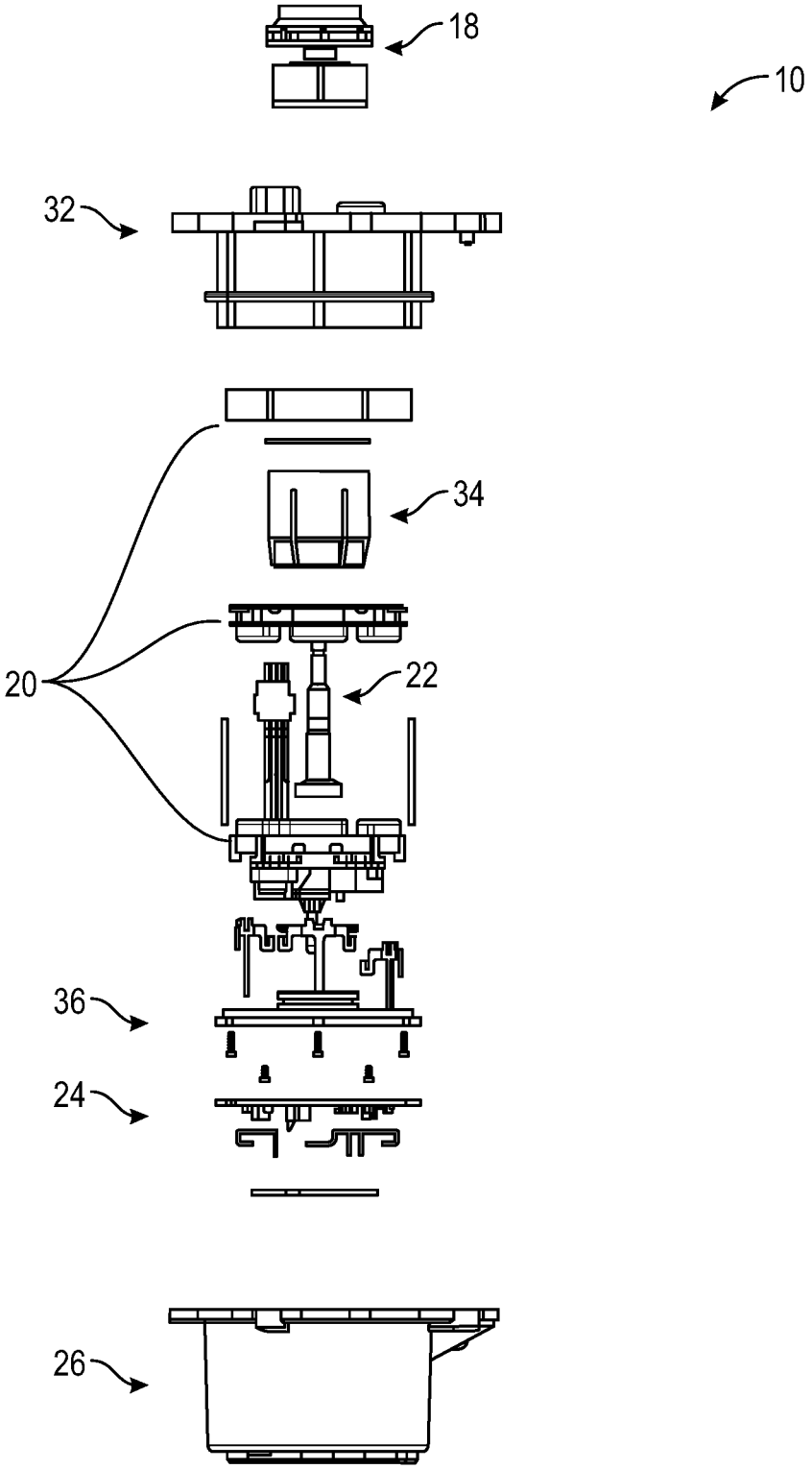
FIG. 10 is an alternative expanded view of the electric coolant pump as described in FIG. 1 showing the control circuit, end cap, stator, rotor shaft, and rotor tube layered between the cover and main body of the housing with the rotor-impeller assembly configured to fit within the main body of the housing.
Figure 11:
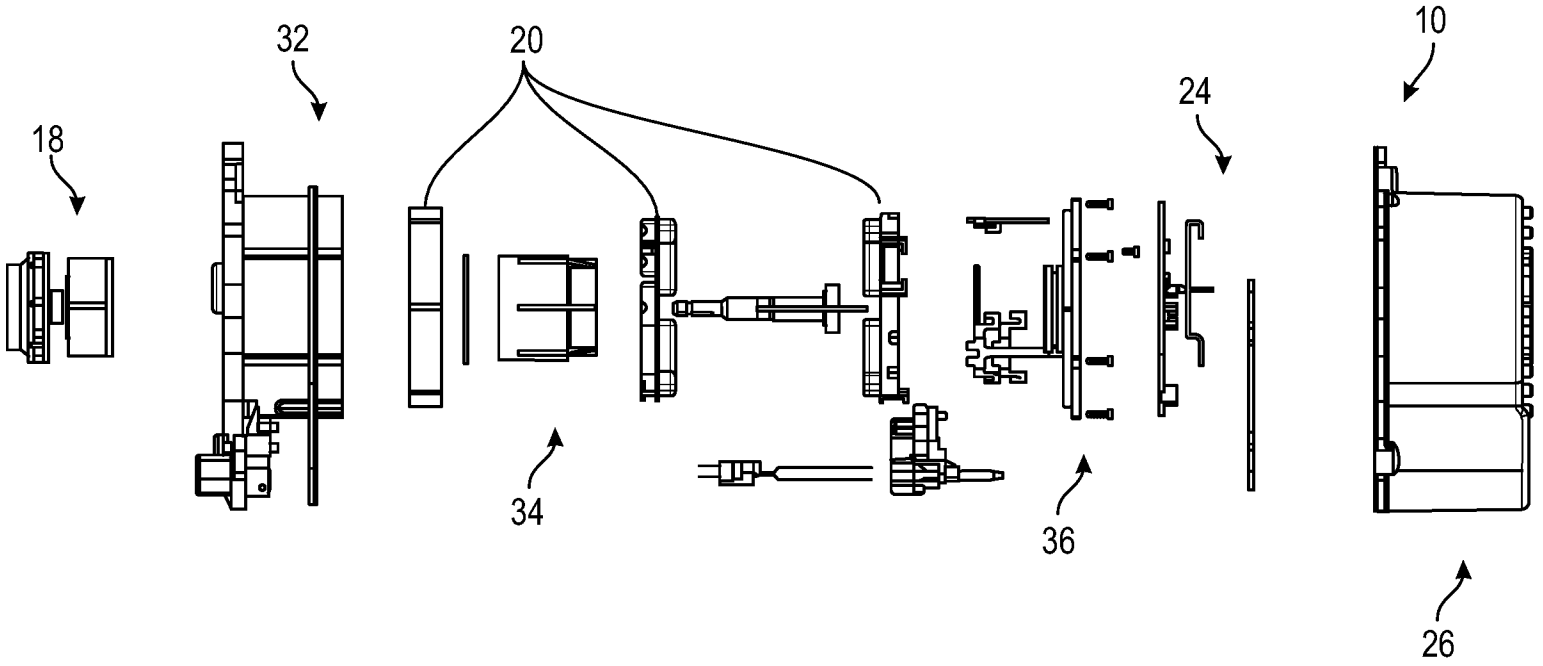
FIG. 11 is an alternative expanded view of the electric coolant pump as described in FIG. 1 showing the control circuit, end cap, stator, and rotor tube layered between the cover and main body of the housing with the rotor-impeller assembly configured to fit within the main body of the housing.
Figure 12:
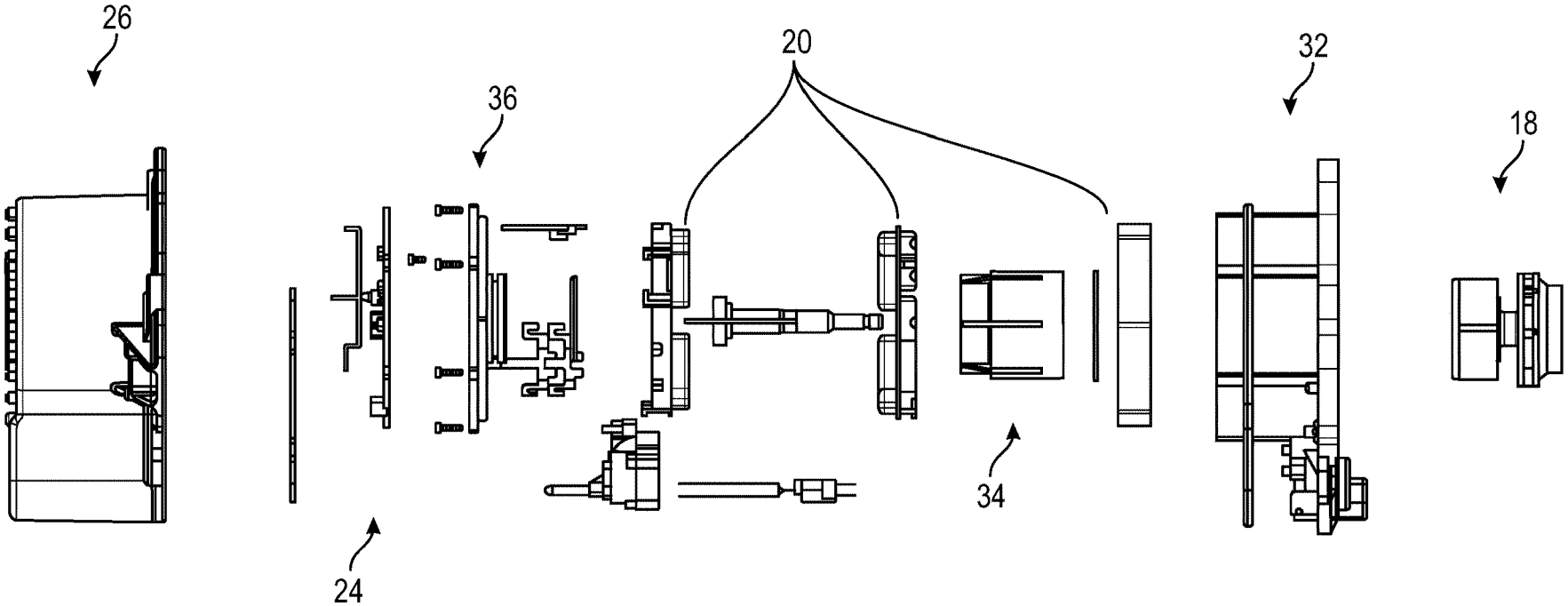
FIG. 12 is an additional expanded view of the electric coolant pump as described in FIG. 1 showing the control circuit, end cap, stator, and rotor tube layered between the cover and main body of the housing with the rotor-impeller assembly configured to fit within the main body of the housing.
Figure 13:
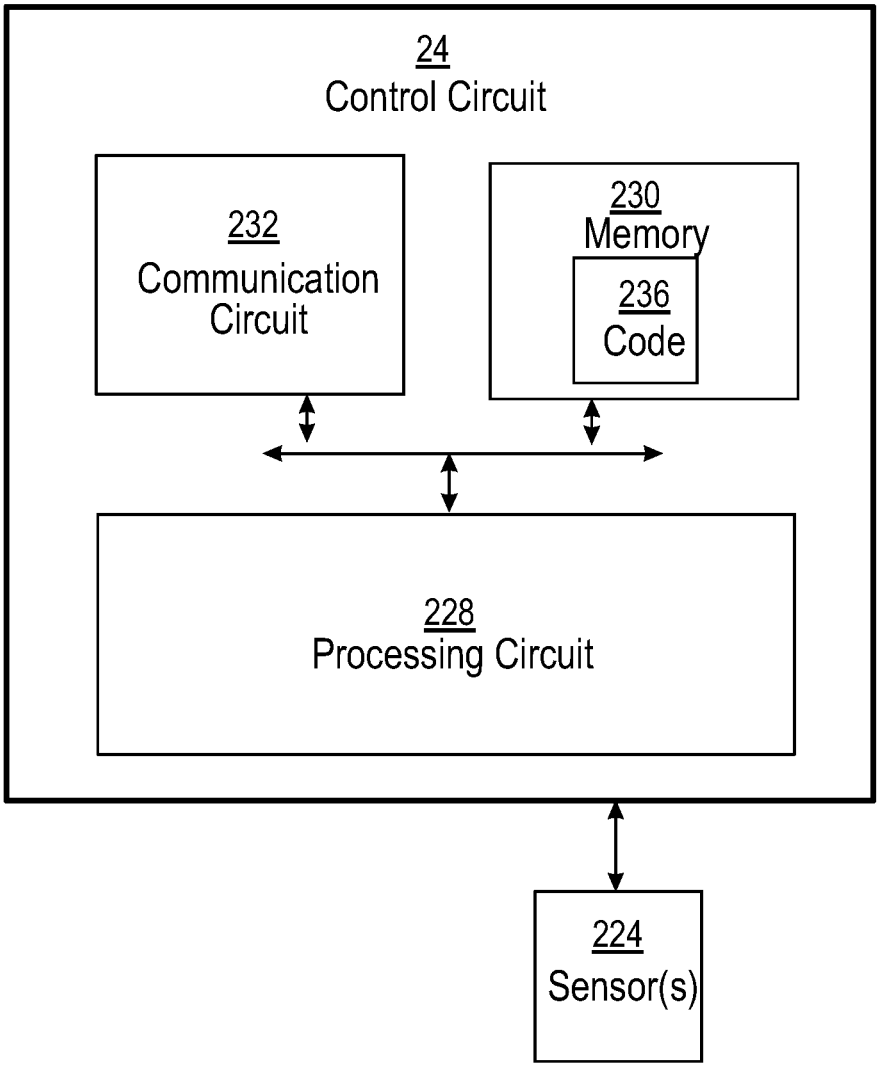
FIG. 13 is a view of the control circuit of the electric coolant pump of FIG. 1, wherein the control circuit includes a communication circuit, a processing circuit, memory containing code, and sensors.

In the following detailed description of the embodiments, reference is made to the accompanying drawings which form a part hereof, and in which is shown by way of illustration specific embodiments in which the disclosure may be practiced. The embodiments of the present disclosure described below are not intended to be exhaustive or to limit the disclosure to the precise forms in the following detailed description. Rather, the embodiments are chosen and described so that others skilled in the art may appreciate and understand the principles and practices of the present disclosure. It will be understood by those skilled in the art that various changes in form and details may be made without departing from the principles and scope of the invention. It is intended to cover various modifications and similar arrangements and procedures, and the scope of the appended claims therefore should be accorded the broadest interpretation so as to encompass all such modifications and similar arrangements and procedures. For instance, although aspects and features may be illustrated in or described with reference to certain figures or embodiments, it will be appreciated that features from one figure or embodiment may be combined with features of another figure or embodiment even though the combination is not explicitly shown or explicitly described as a combination. In the depicted embodiments, like reference numbers refer to like elements throughout the various drawings.

It should be understood that any advantages and/or improvements discussed herein may not be provided by some various disclosed embodiments, or implementations thereof. The contemplated embodiments are not so limited and should not be interpreted as being restricted to embodiments which provide such advantages or improvements. Similarly, it should be understood that various embodiments may not address all or any objects of the disclosure or objects of the invention that may be described herein. The contemplated embodiments are not so limited and should not be interpreted as being restricted to embodiments which address such objects of the disclosure or invention. Furthermore, although some disclosed embodiments may be described relative to specific materials, embodiments are not limited to the specific materials or apparatuses but only to their specific characteristics and capabilities and other materials and apparatuses can be substituted as is well understood by those skilled in the art in view of the present disclosure.

It is to be understood that the terms such as "left, right, top, bottom, front, back, side, height, length, width, upper, lower, interior, exterior, inner, outer, and the like as may be used herein, merely describe points of reference and do not limit the present invention to any particular orientation or configuration.

As used herein, "and/or" includes all combinations of one or more of the associated listed items, such that "A and/or B" includes "A but not B," "B but not A," and "A as well as B," unless it is clearly indicated that only a single item, subgroup of items, or all items are present. The use of "etc." is defined as "et cetera" and indicates the inclusion of all other elements belonging to the same group of the preceding items, in any "and/or" combination(s). As used herein, the singular forms "a," "an," and "the" are intended to include both the singular and plural forms, unless the language explicitly indicates otherwise. Indefinite articles like "a" and "an" introduce or refer to any modified term, both previously-introduced and not, while definite articles like "the" refer to a same previously-introduced term; as such, it is understood that "a" or "an" modify items that are permitted to be previously-introduced or new, while definite articles modify an item that is the same as immediately previously presented. It will be further understood that the terms "comprises," "comprising," "includes," and/or "including," when used herein, specify the presence of stated features, characteristics, steps, operations, elements, and/or components, but do not themselves preclude the presence or addition of one or more other features, characteristics, steps, operations, elements, components, and/or groups thereof, unless expressly indicated otherwise. For example, if an embodiment of a system is described as comprising an article, it is understood the system is not limited to a single instance of the article unless expressly indicated otherwise, even if elsewhere another embodiment of the system is described as comprising a plurality of articles.

It will be understood that when an element is referred to as being "connected," "coupled," "mated," "attached," "fixed," etc. to another element, it can be directly connected to the other element, and/or intervening elements may be present. In contrast, when an element is referred to as being "directly connected," "directly coupled," "directly engaged" etc. to another element, there are no intervening elements present. Other words used to describe the relationship between elements should be interpreted in a like fashion (e.g., "between" versus "directly between," "adjacent" versus "directly adjacent," "engaged" versus "directly engaged," etc.). Similarly, a term such as "operatively", such as when used as "operatively connected" or "operatively engaged" is to be interpreted as connected or engaged, respectively, in any manner that facilitates operation, which may include being directly connected, indirectly connected, electronically connected, wirelessly connected or connected by any other manner, method or means that facilitates desired operation. Similarly, a term such as "communicatively connected" includes all variations of information exchange and routing between two electronic devices, including intermediary devices, networks, etc., connected wirelessly or not. Similarly, "connected" or other similar language particularly for electronic components is intended to mean connected by any means, either directly or indirectly, wired and/or wirelessly, such that electricity and/or information may be transmitted between the components.

It will be understood that, although the ordinal terms "first," "second," etc. may be used herein to describe various elements, these elements should not be limited to any order by these terms unless specifically stated as such. These terms are used only to distinguish one element from another; where there are "second" or higher ordinals, there merely must be a number of elements, without necessarily any difference or other relationship. For example, a first element could be termed a second element, and, similarly, a second element could be termed a first element, without departing from the scope of example embodiments or methods.

Similarly, the structures and operations discussed herein may occur out of the order described and/or noted in the figures. For example, two operations and/or figures shown in succession may in fact be executed concurrently or may sometimes be executed in the reverse order, depending upon the functionality/acts involved. Similarly, individual operations within example methods described below may be executed repetitively, individually, or sequentially, to provide looping or other series of operations aside from single operations described below. It should be presumed that any embodiment or method having features and functionality described below, in any workable combination, falls within the scope of example embodiments.

As used herein, various disclosed embodiments may be primarily described in the context of automotive electric coolant pumps. However, the embodiments are not so limited. It is appreciated that the embodiments may be adapted for use in various other applications, which may be improved by the disclosed structures, arrangements and/or methods. The support system is merely shown and described as being used in the context of automotive electric coolant pumps for ease of description and as one of countless examples.

System 10:

With reference to the figures, an electric coolant pump system 10 ("machine" or "system") is presented. In one or more arrangements, the electric coolant pump system 10 includes a housing 14 having an expansion compensating seal 16, rotor impeller assembly 18, a stator 20, a rotor shaft 22, a control circuit 24, and a cover 26 among other components.

Housing 14:

Housing 14 is formed of any suitable size, shape, or design and is configured to enclose and operably connect rotor impeller assembly 18, a stator 20, a rotor shaft 22 and various other components of system 10. In the arrangement shown, as one example, housing 14 includes a main body 32, a rotor tube 34, and an end cap 36, among other components.

Main Body 32:

Main Body 32 is formed of any suitable size, shape, or design and is configured to form a hollow interior with an open front for housing of components and facilitate connection between such components. In the arrangement shown, as one example, main body 32 has a front portion 40 and a rear portion 42.

In this example arrangement, front portion 40 has a generally cylindrical tube shape extending from a front end 46 to a rear end 48, where front portion 40 connects with rear portion 42. Rear portion 42 is formed of any suitable size, shape, or design and is configured to cover the rear end 48 of front portion 40, facilitate connection with cover 26, and facilitate movement of fluid by operation of impeller 152 of rotor impeller assembly 18. In the arrangement shown, as one example, rear portion 42 has a generally planar shape having a back surface 58 and a front surface 60 extending inward from rear end 48 of front portion 40 in an inner edge 54 of a circular opening 52.

In this example arrangement, rear portion 42 also extends outward from rear end 48 of front portion 40 to an outer edge 56. In various different arrangements, outer edge 56 of rear portion 42 may have various different shapes when viewed from the rear that facilitate fitting and connecting rear portion 42 to an engine and/or match the shape of cover 26 to form an enclosure.

In the arrangement shown, as one example, rear portion 42 extends outward from rear end 48 of front portion 40 to form a number of flanges 64 with holes 66 therethrough to facilitate connection with an engine by fasteners 72 (not shown) such as bolts, screws, or another type of fastener. In this example arrangement, a lower portion 68 of rear end 48 extends downward from front portion 40 and forms an enclosure with cover 26 when assembled. In this example arrangement, lower portion 68 includes an electrical connector 70 therein to facilitate connection of between a car or engine and control circuit 24, stator 20, or other electric components of system 10.

In this example arrangement, back surface 58 of rear portion 42 has a recess 74 proximate to opening 52. When connected to an engine, the recess 74 forms part of a fluidic path, in which rotation of impeller 152 of rotor impeller assembly 18 facilitates pumping of fluids.

In this example arrangement, rear portion 42 of main body 32 includes a collar 80. Collar 80 is formed of any suitable size, shape, or design and is configured to facilitate connection between rotor tube 34. In this example arrangement, collar 80 is positioned around opening 52 and extends forward from front surface 60. In this example arrangement, opening 52 has a slightly smaller diameter than collar 80 so inner edge 54 has a generally cylindrical tube shape. In this example arrangement, inner edge 54 of rear portion 42 forms a lip 82 that extends inward from collar 80.

Rotor Tube 34:

Rotor tube 34 is formed of any suitable size, shape, or design and is configured to be positioned within and partition or subdivide main body 32 to form an inner chamber 90 and an outer chamber 92 when system 10 is assembled. In the arrangement shown, as one example, rotor tube 34 has a generally cylindrical tube shape extending from a rearward end 94 to a forward end 96. In this example arrangement, rotor tube 34 has an outer diameter configured to fit snuggly within collar 80 with tight tolerances. When rearward end 94 of rotor tube 34 is positioned within collar 80, rearward end 94 contacts lip 82 and an inner diameter of rotor tube 34 is flush with inner edge 54 of opening 52. In this example arrangement, rotor impeller assembly 18 is positioned within rotor tube 34 with rotor shaft 22 extending through rotor impeller assembly 18 and with an impeller 152 of rotor impeller assembly 34 extending out from opening 52.

In this example arrangement, rotor tube 34 includes a front wall 100 extending across forward end 96 of rotor tube 34. In this example arrangement, front wall 100 has a cylindrical opening 102 through which rotor shaft 22 extends. In this example arrangement, rotor tube 34 includes an inner collar 104 and an outer collar 106 extending forward from front wall 100 and forward end 96.

Inner collar 104 is formed of any suitable size, shape, or design and is configured to receive and hold a head 130 of rotor shaft 22 between rotor tube 34. In this example arrangement, inner collar 104 has a generally cylindrical tube shape extending forward from a rearward end 110 connected to front wall 100 to a forward end 112. In this example arrangement, inner collar 104 is positioned around opening 102. In this example arrangement, opening 102 has a smaller diameter than inner collar 104 so front wall 100 extends inward from inner collar 104 to form a lip 108. In this example arrangement, an interior surface of inner collar 104 contacts an exterior surface 134 of head 130 and lip 108 contacts a rear surface 136 of head 130 with close and tight tolerances to hold rotor shaft 22 firmly in position during operation.

Outer collar 106 is formed of any suitable size, shape, or design and is configured to receive and hold an inner portion 174 of end cap 36 of housing 14 therein. In this example arrangement, collar 106 has a generally cylindrical tube shape extending forward from a rearward end 114 connected to front wall 100 to a forward end 116. In this example arrangement, outer collar 106 is positioned around inner collar 104 and has a slightly smaller diameter than forward end 96 of rotor tube 34

End Cap 36:

End Cap 36 is formed of any suitable size, shape, or design and is configured to removably connect to front portion 40 of main body 32 of housing 14, hold rotor shaft 22 within inner collar 104 of rotor tube 34, and enclose housing 14. In the arrangement shown, as one example, end cap 36 has an outer portion 172 and an inner portion 174.

Outer portion 172 of end cap 36 is formed of any suitable size, shape, or design and is configured to fit over front end 46 of front portion 40 of main body 32 and facilitate connection with main body 32 of housing 14. In the arrangement shown, as one example, outer portion 172 has generally planar disc shape having a front surface 178 and a rear surface 180 extending outward from its center to an outer edge 182. In this example arrangement, outer portion has a recess 186 in rear surface 180 proximate to outer edge 182. When system 100 is assembled, front end 46 of front portion 40 of main body 32 is positioned in recess 186 of outer portion 172.

In this example arrangement, outer portion 170 has holes 184 positioned proximate to outer edge to facilitate connection with front end 46 of front portion 40 of main body 32 by fasteners 188 (e.g., screws, bolts, or other fasteners) that extend through holes 184 and into front portion 40. However, embodiments are not so limited. Rather, it is contemplated that in some various arrangements end cap 36 may be connected to main body 32 using various processes and means including, for example, welding, rivets, pins, clamps, bolts, screws, adhesives, chemical bonding, and/or any other process or means that results in a permanent or semi-permanent connection.

Inner portion 174 of end cap 36 is formed of any suitable size, shape, or design and is configured to fit into outer collar 106 and hold rotor shaft 22 within inner collar 104. In the arrangement show, as one example, inner portion 174 has a generally cylindrical shape having an outer edge 194 extending rearward from rear surface 180 of outer portion 172 to a back surface 196. When system 10 is assembled, back surface 196 engages forward end 112 of inner collar 104 and front surface 138 of head 130 of rotor shaft 22, thereby holding head 130 of rotor shaft 22 in place within inner collar 104.

Expansion Compensating Seal 16:

Expansion compensating seal 16 is formed of any suitable size, shape, or design and is configured to provide and maintain a water tight seal between a surface of the end cap 36 and a surface of main body 32 of housing 14 while such surfaces shift due to thermal expansion/contraction of various components of system 10.

In the arrangement shown, as one example, expansion compensating seal 16 is positioned to provide a seal between outer edge 194 of inner portion 174 of end cap 36 and an inner surface of outer collar 106 of rotor tube 34. In this example arrangement, expansion compensating seal 16 includes a recessed channel 202 extending around outer edge 194 of inner portion 174 of end cap 36 and a seal 204 positioned within recessed channel 202. In some various arrangements, seal 204 may be formed of any compressible material that is capable of forming a water tight (or nearly water tight) seal such as rubber, foam, plastic, composite, nylon, neoprene, a polymer, or any other compressible material and/or combination thereof.

In this example arrangement, seal 204 is sized so seal 204 extends outward from recessed channel 202 and is compressed between outer edge 194 of inner portion 174 of end cap 36 and an inner surface of outer collar 106 of rotor tube 34 when inner portion 174 is inserted into outer collar 106. In this example arrangement, recessed channel 202 helps maintain proper positioning of seal 204 as surfaces of end cap 36 and rotor tube 34 shift due to thermal expansion/contraction.

However, embodiments are not so limited. Rather, it is contemplated that, in one or more arrangements, recessed channel 202 may alternatively be formed in the interior surface of outer collar 106 of rotor tube 34. Furthermore, it is contemplated that, in one or more arrangements, expansion compensating seal 16 may additionally or alternatively be positioned at various other locations to form a seal between end cap 36 and main body 32 of housing 14. For example, in one or more arrangements, expansion compensating seal 16 may be positioned to provide a seal between exterior surface 134 of head 130 of rotor shaft 22 and an interior surface of inner collar 104 of rotor tube 34. Furthermore, it is contemplated that, in various arrangements, system 10 may include any number of expansion compensating seals 16 between end cap 36 and main body 32 of housing 14.

Rotor Shaft 22:

Rotor shaft 22 is formed of any suitable size, shape, or design and is configured to be held securely in place within inner chamber 90 defined by rotor tube 34 and operate as an axle for rotor impeller assembly 18 to rotate thereon. In the arrangement shown, as one example, rotor shaft 22 has a generally elongated cylindrical shape extending from a rearward end 120 to a forward end 122. In this example arrangement, rotor shaft 22 has a wider portion 124 extending from forward end 122 to a step 126 and a narrow portion 128 extending from the step 126 to the rearward end 120.

In this example arrangement, rotor shaft 22 includes a head 130 connected to forward end 122. Head 130 is formed of any suitable size, shape, or design, and is configured to be received and held within inner collar 104 of rotor tube 34 with close and tight tolerances to hold rotor shaft 22 securely in position. In the arrangement shown, as one example, head 130 has a generally cylindrical exterior surface 134 extending from a rear surface 136 to a front surface 138. In this example arrangement, head 130 is positioned within inner collar 104 and with wider portion 124 extending rearwards from rear surface 136 through opening 102, through rotor impeller assembly 18 in inner chamber 90. In this example arrangement, an interior surface of inner collar 104 contacts an exterior surface 134 of head 130 and lip 108 contacts a rear surface 136 of head 130 with close and tight tolerances to hold rotor shaft 22 firmly in position during operation.

In one or more arrangements, rotor shaft 22 has a connection feature 140 proximate to rearward end 120 of rotor shaft 22. Connection feature 140 is formed of any suitable size, shape, or design, and is configured to hold rotor impeller assembly 18 on rotor shaft 22.

In the arrangement shown, as one example, connection feature 140 is a notch that may be used to hold rotor impeller assembly 18 on rotor shaft 22 using, for example, a c-clip. However, the embodiments are not so limited. Rather, it is contemplated that in some various arrangements, rotor impeller assembly 18 may be held on rotor shaft 22 using various processes and means including, for example, welding, rivets, pins, clamps, bolts, screws, adhesives, chemical bonding, and/or any other process or means that results in a permanent or semi-permanent connection.

Rotor Impeller Assembly 18:

Rotor impeller assembly 18 is formed of any suitable size, shape, or design and is configured to rotate on rotor shaft 22 in inner chamber 90 in response to a rotating electromagnetic field generated by stator 20 and facilitate movement of fluid when rotating. In the arrangement shown, as one example, rotor impeller assembly 18 includes a rotor 150 and an impeller 152 operably connected to rotor 150.

Rotor 150:

Rotor 150 is formed of any suitable size, shape, or design and is configured to rotate on rotor shaft 22 in inner chamber 90 in response to a rotating electromagnetic field generated by stator 20. In the arrangement shown, as one example, rotor 150 has a generally spherical doughnut shape with one or more magnetics 156 (not shown) position therein. Polarity of magnets 156 are positioned to induce rotation of rotor 150 in response to the electromagnetic field generated by stator 20 during operation. In this example, rotor 150 is operably connected to impeller 152 by a generally cylindrical tube 154 that extends through a center of rotor 150 and impeller 152. However, embodiments are not so limited. Rather, it is contemplated that in various different arrangements, rotor 150 may be operably connected to impeller 152 using various processes and means including, for example, welding, rivets, pins, clamps, bolts, screws, adhesives, chemical bonding, and/or any other process or means that results in a permanent or semi-permanent connection.

Impeller 152:

Impeller 152 is formed of any suitable size, shape, or design and is configured to induce flow of fluid when rotated. Various different arrangements may use various different types of impellers including but not limited to, for example, open impellers, semi-closed impellers, closed or shrouded impellers, flexible impellers, and/or any other type of impeller. Such impeller 152 may be configured for axial flow, radial flow, right hand rotation, left hand rotation, and/or any combination of these and other configurations of impeller 152.

Stator 20:

Stator 20 is formed of any suitable size, shape, or design and is configured to generate an electromagnetic field to induce rotation of rotor impeller assembly 18. In the arrangement shown, as one example, stator 20 has a ring shaped member 164 positioned around rotor tube 34 in outer chamber 92 of housing 14. In this example arrangement, stator 20 includes one or more field coils 166 positioned at various positions around ring shaped member 164. In this example arrangement, field coils 166 as configured to generate a rotating electromagnetic field during operation to cause rotor 150 to rotate on rotor shaft 22 in inner chamber 90 during operation.

Control Circuit 24:

Control circuit 24 is formed of any suitable size, shape, design, technology, and in any arrangement and is configured to control operation of other components of system 10 to facilitate operation in response to control signals (e.g., from a control system of an automobile) and/or sensors 224.

Sensors 224 may include but are not limited to, for example, pressure sensors, temperature sensors, voltage sensors, current sensors, flow rate sensors, and/or any other type of sensor. In the arrangement shown, as one example implementation, control circuit 24 includes a processing circuit 228 and memory 230 having software code 236 or instructions that facilitates the computational operation of system 10. Processing circuit 228 may be any computing device that receives and processes information and outputs commands according to software code 236 or instructions stored in memory 230.

Memory 230 may be any form of information storage such as flash memory, ram memory, dram memory, a hard drive, or any other form of memory. Processing circuit 228 and memory 230 may be formed of a single combined unit. Alternatively, processing circuit 228 and memory 230 may be formed of separate but electrically connected components. Alternatively, processing circuit 228 and memory 230 may each be formed of multiple separate but electrically connected components.

Software code 236 or instructions are any form of information or rules that direct processing circuit 228 how to receive, interpret and respond to information to operate as described herein. Software code 236 or instructions are stored in memory 230 and accessible to processing circuit 228. As an illustrative example, in one or more arrangements, software code 236 or instructions may configure processing circuit 228 to control stator 20 in response to control signals received via an electrical connector 70

Communication circuit 232 is formed of any suitable size, shape, design, technology, and in any arrangement and is configured to facilitate communication with other devices such as a control system of an automobile. In one or more arrangements, as one example, communication circuit 232 is a includes a transmitter (for one way communication) or transceiver (for two way communication). In various arrangements, communication circuit 232 may be configure to communicate with various components of system 10 using various wired and/or wireless communication technologies and protocols over various networks and/or mediums including but not limited to, for example, Serial Data Interface 12 (SDI-12), UART, Serial Peripheral Interface, PCI/PCIe, Serial ATA, ARM Advanced Microcontroller Bus Architecture (AMBA), CAN, LIN, FlexRay, MOST, OBDII, SAE J1850, SAE J1708, USB, Firewire, RFID, Near Field Communication, infrared and optical communication, 802.3/Ethernet, 802.11/WIFI, Wi-Max, Bluetooth, Bluetooth low energy, UltraWideband (UWB), 802.15.4/ZigBee, ZWave, GSM/EDGE, UMTS/HSPA+/HSDPA, CDMA, LTE, FM/VHF/UHF networks, and/or any other communication protocol, technology or network.

However, the embodiments are not so limited. Rather, it is contemplated that components of system 10 may be controlled using various other control circuit arrangements or may have control circuit 24 omitted. For example, in one or more arrangements system 10 may be controlled solely by an external system that controls operation by adjusting an amount of power provide to system 10 via an electrical connector 70.

Cover 26:

Cover 26 is formed of any suitable size, shape, or design and is configured to attach to housing 14 to enclose components of the system 10 and prevent environmental dust, debris, and liquids from interfering with components of system 10. In the arrangement shown, as one example, cover 26 has a front 240, sidewalls 242, a top 244, and a bottom 246 extending rearward from front 240 to a back end 248, and one or more flanges 250 extending outward from the sidewalls 242, top 244 and bottom 246 at the back end 248.

In this example arrangement, when viewed from the front, front 240 of cover 26 has a generally circular shaped upper portion 252 and a mandible shaped lower portion 254 extending downward from upper portion 252. In this example arrangement, sidewalls 242, top 244 and bottom 246 have shapes matching the curvature of outer edge 256 of front 240 and extend rearward therefrom to back end 248. In this example arrangement, flanges 250 extending outward from the sidewalls 242, top 244, and bottom 246 at the back end 248 to an outer edge 258 that has a shape that matches outer edge 56 of rear portion 42 of main body 32 of housing 14.

In this example arrangement, flanges 250 of cover 26 are configured to mate and connect with flanges 64 of rear portion 42 of main body 32 of housing 14 when installed. In this example arrangement, flanges 250 have holes 262 to facilitate connection with flanges 64 by fasteners 264 (not shown) (e.g., screws, bolts, or other type of fastener) and/or with to facilitate connection of system 10 to an engine.

In this example arrangement, a seal 266 is positioned on front surface 60 of rear portion 42 of main body 32 of housing 14 and is configured to provide a seal between housing 14 and back end 248 of cover 26, for example to prevent environmental dust, debris, or liquids from interfering with components of system 10.

In Operation

During operation of system 10, power and/or control signals are provided to control circuit 24. To initiate pumping of coolant, control circuit 24 causes power to be provided to stator 20, which generates a rotating electromagnetic field. Magnets 156 of rotor 150 of rotor impeller assembly 18 cause rotor 150 and impeller 152 to rotate. Rotation of impeller 152 causes coolant between the engine and recess 74 of rear portion 42 of main body 32 to be pumped through the cooling system of the car.

During this operation, coolant may seep in between rotor shaft 22 and impeller assembly 18 and/or between impellor assembly and rotor tube 34. Such coolant may eventually continue though opening 102 of front wall 100 of rotor tube 34, around head 130 of rotor shaft, and along gaps between end cap 36 and rotor tube 34 of housing 14 until expansion compensating seal 16 is encountered, which prevents the coolant from exiting rotor tube 34.

As previously described, as the engine coolant is heated by the running engine, various components of system 10 expand at different rates. Due to positioning of expansion compensating seal 16 between surfaces of the end cap 36 and a surface of rotor tube 34 of housing 14 that can slide relative to one another when the components expand, seal 204 of expansion compensating seal 16 is able to maintain a seal between end cap 36 and main body 32 of housing 14 during operation, despite thermal expansion/contraction of components.

From the above discussion it will be appreciated that the disclosed electric coolant pump system improves upon the state of the art. That is, in one or more arrangements, an electric coolant pump system 10 is presented: that has a seal configured to compensate for thermal expansion/contraction of components; that is serviceable; that has a durable design; that has a long useful life; that is low cost; and/or that is easy to manufacture among countless other advantages, improvements and features.

It will be appreciated by those skilled in the art that other various modifications could be made to the device without parting from the spirit and scope of this invention. All such modifications and changes fall within the scope of the claims and are intended to be covered thereby.

What is claimed is:

1. An electric coolant pump system, comprising:
a housing
the housing having a main body and an end cap;
the main body having a hollow interior and an open end;
the end cap operably connected to the main body and closing the open end of the main body;
a rotor shaft;
the rotor shaft operably connected to the housing;
a rotor;
the rotor operably connected to the rotor shaft and positioned within the hollow interior;
an impeller operably connected to the rotor;
wherein the impeller is configured to pump coolant when rotated;
wherein one or more components of the electric coolant pump system thermally expand and contract as the coolant is heated and cooled;
an expansion compensating seal;
wherein the expansion compensating seal is configured to provide and maintain a water tight seal to prevent the coolant from leaking out from the housing as the one or more components thermally expand and contract,
wherein the expansion compensating seal is positioned between an outward facing surface of a head of the rotor shaft and an inward facing surface of the housing;
wherein the expansion compensating seal includes a recessed channel formed in the outward facing surface of the head of the rotor shaft;
wherein the expansion compensating seal includes a seal member positioned in the recessed channel.

2. The system of claim 1, wherein the housing includes a rotor tube positioned within the main body;
wherein the rotor tube is operably connected to the main body and partitions the hollow interior into an inner chamber and an outer chamber;
wherein the rotor is positioned within the inner chamber.

3. The system of claim 1, wherein the housing includes a rotor tube positioned within the main body;
wherein the rotor tube is operably connected to the main body and partitions the hollow interior into an inner chamber and an outer chamber;
wherein the rotor is positioned within the inner chamber;
wherein the system includes a stator wherein the stator is positioned in the outer chamber;
wherein the stator is configured to generate an electromagnetic field during operation that causes the rotor to rotate.

4. An electric coolant pump system, comprising:
a housing
the housing having a main body and an end cap;
the main body having a hollow interior and an open end;

the end cap operably connected to the main body and closing the open end of the main body;

a rotor shaft;

the rotor shaft operably connected to the housing;

a rotor;

the rotor operably connected to the rotor shaft and positioned within the hollow interior;

an impeller operably connected to the rotor;

wherein the impeller is configured to pump coolant when rotated;

wherein one or more components of the electric coolant pump system thermally expand and contract as the coolant is heated and cooled;

an expansion compensating seal;

wherein the expansion compensating seal is configured to provide and maintain a water tight seal to prevent the coolant from leaking out from the housing as the one or more components thermally expand and contract;

wherein the housing includes a rotor tube positioned within the main body;

wherein the rotor tube is operably connected to the main body and partitions the hollow interior into an inner chamber and an outer chamber;

wherein the rotor is positioned within the inner chamber;

wherein the rotor tube has a cylindrical tube shape extending from a first end to a second end;

wherein the rotor tube has a wall extending across the first end of the rotor tube;

wherein the wall has a cylindrical opening;

wherein the rotor tube has a collar positioned around the cylindrical opening extending out from the wall;

wherein rotor shaft includes a head positioned within the collar;

wherein the rotor shaft includes a shaft portion extending from the head, through the cylindrical opening and into the inner chamber;

wherein the head is held within the collar of the rotor tube by the end cap.

5. The system of claim 4, wherein the expansion compensating seal is positioned between an outward facing surface of the end cap and an inward facing surface of the housing.

6. The system of claim 4, wherein the expansion compensating seal is positioned between an outward facing surface of the end cap and an inward facing surface of the housing;

wherein the expansion compensating seal includes a recessed channel formed in the outward facing surface of the end cap;

wherein the expansion compensating seal includes a seal member positioned in the recessed channel.

7. An electric coolant pump system, comprising:

a housing;

the housing having a main body, a rotor tube, and an end cap;

main body having a hollow interior and an open end;

wherein the end cap is operably connected to the main body and closes the open end of the main body;

wherein the rotor tube has an elongated cylindrical shape extending between opposing ends;

wherein the rotor tube is positioned in the main body and partitions the hollow interior into an inner chamber and an outer chamber;

a rotor shaft;

the rotor shaft operably connected to the rotor tube and extending into the inner chamber;

a rotor;

the rotor positioned on the rotor shaft within the inner chamber;

an impeller operably connected to the rotor;

wherein the impeller is configured to pump coolant when rotated;

wherein one or more components of the electric coolant pump system thermally expand and contract as the coolant is heated and cooled;

an expansion compensating seal;

wherein the expansion compensating seal is configured to provide and maintain a water tight seal to prevent the coolant from leaking out from the inner chamber as the one or more components thermally expand and contract;

wherein the rotor tube has a cylindrical tube shape extending from a first end to a second end;

wherein the rotor tube has a wall extending across the first end of the rotor tube;

wherein the wall has a cylindrical opening;

wherein the rotor tube has a collar positioned around the cylindrical opening extending out from the wall;

wherein rotor shaft includes a head positioned within the collar;

wherein the rotor shaft includes a shaft portion extending from the head, through the cylindrical opening and into the inner chamber;

wherein the head is held within the collar of the rotor tube by the end cap.

8. The system of claim 7, wherein the expansion compensating seal is positioned between the end cap and the rotor tube of the housing.

9. The system of claim 7, wherein the expansion compensating seal is positioned between the rotor shaft and the rotor tube of the housing.

10. The system of claim 7, further comprising a stator positioned in the outer chamber;

wherein the stator is configured to generate an electromagnetic field during operation that causes the rotor to rotate.

11. The system of claim 7, wherein the expansion compensating seal is positioned between an outward facing surface of the end cap and an inward facing surface of the rotor tube.

12. The system of claim 7, wherein the expansion compensating seal is positioned between an outward facing surface of the rotor shaft and an inward facing surface of the rotor tube.

13. The system of claim 7, wherein the expansion compensating seal is positioned between an outward facing surface of the end cap and an inward facing surface of the rotor tube;

wherein the expansion compensating seal includes a recessed channel formed in the outward facing surface of the end cap;

wherein the expansion compensating seal includes a seal member positioned in the recessed channel.

14. An electric coolant pump system, comprising:

a housing;

the housing having a main body, a rotor tube, and an end cap;

main body having a hollow interior and an open end;

wherein the end cap is operably connected to the main body and closes the open end of the main body;

wherein the rotor tube has an elongated cylindrical shape extending between opposing ends;

wherein the rotor tube is positioned in the main body and partitions the hollow interior into an inner chamber and an outer chamber;

a rotor shaft;

the rotor shaft operably connected to the rotor tube and extending into the inner chamber;

a rotor;

the rotor positioned on the rotor shaft within the inner chamber;

an impeller operably connected to the rotor;

wherein the impeller is configured to pump coolant when rotated;

wherein one or more components of the electric coolant pump system thermally expand and contract as the coolant is heated and cooled;

an expansion compensating seal;

wherein the expansion compensating seal is configured to provide and maintain a water tight seal to prevent the coolant from leaking out from the inner chamber as the one or more components thermally expand and contract;

wherein the expansion compensating seal is positioned between an outward facing surface of the rotor shaft and an inward facing surface of the rotor tube;

wherein the expansion compensating seal includes a recessed channel formed in the outward facing surface of the rotor shaft;

wherein the expansion compensating seal includes a seal positioned in the recessed channel.

15. An electric coolant pump system, comprising:

a housing;

the housing having a main body, a rotor tube, and an end cap;

the main body having a hollow interior and an open end;

wherein the end cap is operably connected to the main body and closes the open end of the main body;

wherein the rotor tube has an elongated cylindrical shape extending between opposing ends;

wherein the rotor tube is positioned in the main body and partitions the hollow interior into an inner chamber and an outer chamber;

wherein the rotor tube has a wall extending across the first end of the rotor tube;

wherein the wall has a cylindrical opening;

wherein the rotor tube has a collar positioned around the cylindrical opening extending out from the wall;

a rotor shaft;

the rotor shaft operably connected to the rotor tube and extending into the inner chamber;

wherein rotor shaft includes a head positioned within the collar;

wherein the rotor shaft includes a shaft portion extending from the head, through the cylindrical opening and into the inner chamber;

wherein the head is held within the collar of the rotor tube by the end cap;

a rotor;

the rotor positioned on the rotor shaft within the inner chamber;

an impeller operably connected to the rotor;

a stator is positioned in the outer chamber;

wherein the stator is configured to generate a electromagnetic field during operation that causes the rotor to rotate;

wherein the impeller is configured to pump coolant when rotated;

wherein one or more components of the electric coolant pump system thermally expand and contract as the coolant is heated and cooled;

an expansion compensating seal;

wherein the expansion compensating seal is configured to provide and maintain a water tight seal to prevent the coolant from leaking out from the inner chamber as the one or more components thermally expand and contract.

* * * * *